US006167226A

United States Patent [19]

Matalevich

[11] Patent Number: 6,167,226

[45] Date of Patent: Dec. 26, 2000

[54] DEVELOPMENT SYSTEM

[75] Inventor: Joseph R. E. Matalevich, Suffolk, Va.

[73] Assignee: Xerox Corporation, Stamford, Conn.

[21] Appl. No.: 09/455,979

[22] Filed: Dec. 6, 1999

[51] Int. Cl.[7] ..... G03G 15/08

[52] U.S. Cl. ..... 399/253; 222/DIG. 1

[58] Field of Search ..... 399/253, 252, 399/119, 120; 222/DIG. 1

[56] References Cited

U.S. PATENT DOCUMENTS 4,614,165 9/1986 Folkins et al. ..... 118/657
4,974,024 11/1990 Bares et al. ..... 355/246
5,307,128 4/1994 Murasaki et al. .
5,438,393 8/1995 Komatsu et al. .
5,508,794 4/1996 Ikesue et al. .
5,758,239 5/1998 Matalevich ..... 399/266

*Primary Examiner*—Richard Moses
*Attorney, Agent, or Firm*—H. Fleischer

[57] ABSTRACT

An apparatus which develops an electrostatic latent image recorded on a photoconductive member used in an electrophotographic printing machine. The apparatus employs a development material wherein developability degradates as the duration of time that the toner particles remain in the developer housing increases. Developability is significantly improved by periodically adding a flow additive material to the developer material.

25 Claims, 3 Drawing Sheets

DEVELOPMENT SYSTEM

The present invention relates generally to an electrophotographic printing machine, and more particularly concerns an apparatus for developing an electrostatic latent image recorded on a photoconductive member, wherein the developer material employed in the apparatus has its developability improved by adding a flow additive material thereto at selected intervals of time.

In a typical electrophotographic printing process, a photoconductive member is sensitized by charging its surface to a substantially uniform potential. The charged portion of the photoconductive member is exposed to a light image of an original document being reproduced. Exposure of the charged photoconductive member selectively dissipates the charge in the irradiated areas to record an electrostatic latent image on the photoconductive member. After the electrostatic latent image is recorded on the photoconductive member, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. The toner particles are attracted to the latent image forming a toner powder image on the photoconductive surface. The toner powder image is subsequently transferred to a sheet. Finally, the toner powder image is heated to permanently fuse it to the sheet in image configuration.

Single component development systems use a donor roll for transporting charged toner particles to the development nip defined by the donor roll and photoconductive member. The toner is developed on the latent image recorded on the photoconductive member by a combination of mechanical and/or electrical forces. Scavengeless development and jumping development are two types of single component development. A scavengeless development system uses a donor roll with a plurality of electrode wires closely spaced therefrom in the development zone. An AC voltage is applied to the wires forming a toner cloud in the development zone. Electrostatic fields generated by the latent image attract toner particles from the toner cloud to develop the latent image. In jumping development, an AC voltage is applied to the donor roller detaching toner particles from the donor roller and projecting the toner particles toward the photoconductive member so that the electrostatic fields generated by the latent image attract the toner particles to the latent image. A two component development system generally employs a magnetic brush development roller for transporting carrier granules having toner particles adhering triboelectrically thereto. The electrostatic fields generated by the latent image attract the toner particles from the carrier granules so as to develop the latent image. In order to achieve the advantageous results from each one of these systems, a combination termed "hybrid scavengeless development" has been used. In a hybrid scavengeless development system, a donor roll and a magnetic transport roll are employed. The magnetic transport roll advances a two component developer material of carrier granules and toner particles to the nip defined by the donor roller and the magnetic transport roller. The donor roller and magnetic transport roller are electrically biased with respect to one another. Toner particles are attracted from the carrier granules on the magnetic transport roller to the donor roller. The donor roller is rotated synchronously with the photoconductive member. Electrode wires are positioned in the gap between the donor roller and the photoconductive member. An AC voltage is applied to the electrode wires forming the toner powder cloud in the development zone. Electrostatic fields generated by the latent image attract the toner particles from the toner cloud to develop the latent image. A hybrid scavengeless development system has been found to optimize quality and high speed development. Thus, it is used in high volume commercial electrophotographic printing machines wherein quality is of the utmost importance. Another aspect of improving quality has been to reduce the size of the toner particles.

As the average residence time of the toner particles in the developer housing increases, it has been found that the quality of the resultant developed image starts to degradate. This quality degradation is a function of the throughput rate of the printing machine. Developability degradates inversely as a function of the throughput rate of the printing machine.

In addition to toner particles and carrier granules being used in the development system, a flow additive external additive particles may be added. Flow additives are generally added during the toner manufacturing process. Typical flow additives are described in U.S. Pat. Nos. 3,590,000 and 3,800,588. As the toner particles are depleted in the development process, additional toner particles are added to the chamber of the housing storing the supply of carrier granules and flow additives therein. This maintains the density of the toner particles within the appropriate range.

Many types of systems have been developed for detecting the concentration of toner particles in the developer material. Typically, a closed loop system is used to discharge additional toner particles as a function of depletion thereof within the chamber of developer housing, additional carrier granules may also be dispensed therein in order to extend the useful life of the developer material to correspond at least to the useful life of the electrophotographic printing machine. However, it has been found that in all of the systems heretofore developed, developability still degradates as a function of throughput when small size toner particles are used in a high speed electrophotographic printing machine. Accordingly, it is highly desirable to improve the developability of development systems for used in high speed electrophotographic printing machines. Various approaches have been devised for adding toner particles or carrier granules to the developer material within the development system and for detecting the concentration of toner particles within the system and maintaining that concentration substantially constant. The following disclosures appear to be relevant:

U.S. Pat. No. 4,614,165

Patentee: Folkins, et al.

Issued: Sep. 30, 1986

U.S. Pat. No. 4,974,024

Patentee: Bares, et al.

Issued: Nov. 27, 1990

The relevant portions of the foregoing patents may be briefly summarized as follows:

U.S. Pat. No. 4,614,165 discloses a development system in which both carrier granules and toner particles are periodically added to the developer material contained within the chamber of the developer housing.

U.S. Pat. No. 4,974,024 discloses controlling the dispensing of toner particles into the developer material as a function of the average amount of toner particles required to develop the latent image.

In accordance with one aspect of the present invention, there is provided an apparatus for developing a latent image. The apparatus includes a housing defining a chamber for storing a supply of developer material comprising at least toner particles therein. A developer member is mounted at least partially in the housing. The developer member transports developer material to the latent image, developing the latent image with the toner particles. A discharging device is operatively associated with the housing. The discharging device dispenses a flow additive into the developer material in the chamber of the housing to minimize developability degradation as a function of elapsed time.

Pursuant to another aspect of the present invention, there is provided a cartridge including a housing defining a chamber storing a supply of flow additive material therein. A dispensing mechanism is operatively associated with the housing. The dispensing mechanism discharges the flow additive material from the chamber of the housing.

In still another aspect of the present invention, there is provided a printing machine of the type having a latent image recorded on an image bearing member. The improvement in the printing machine includes a housing defining a chamber for storing a supply of developer material comprising at least toner particles. A developer member is mounted at least partially in the housing. The developer member transports developer material to the latent image to develop the latent image with toner particles. A discharging device is operatively associated with the housing. The discharging device dispenses a flow additive into the developer material in the chamber of the housing to minimize developability degradation as a function of elapsed time.

Still another aspect of the present invention is a method of developing an electrostatic latent image recorded on a photoconductive member used in an electrophotographic printing machine. The method of developing includes transporting a developer material comprising at least toner particles from a housing storing a supply thereof in a chamber to the photoconductive member having the electrostatic latent image recorded thereon. A flow additive is discharged into the developer material in the chamber of the housing to minimize developability degradation as a function of time.

Other features of the present invention will become apparent as the following description proceeds and upon reference to the drawings, in which.

While the present invention will be described in connection with a preferred embodiment and method of use thereof, it will be understood that it is not intended to limit the invention to that embodiment. On the contrary, it is intended to cover all alternatives, modifications, and equivalents that may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 3:
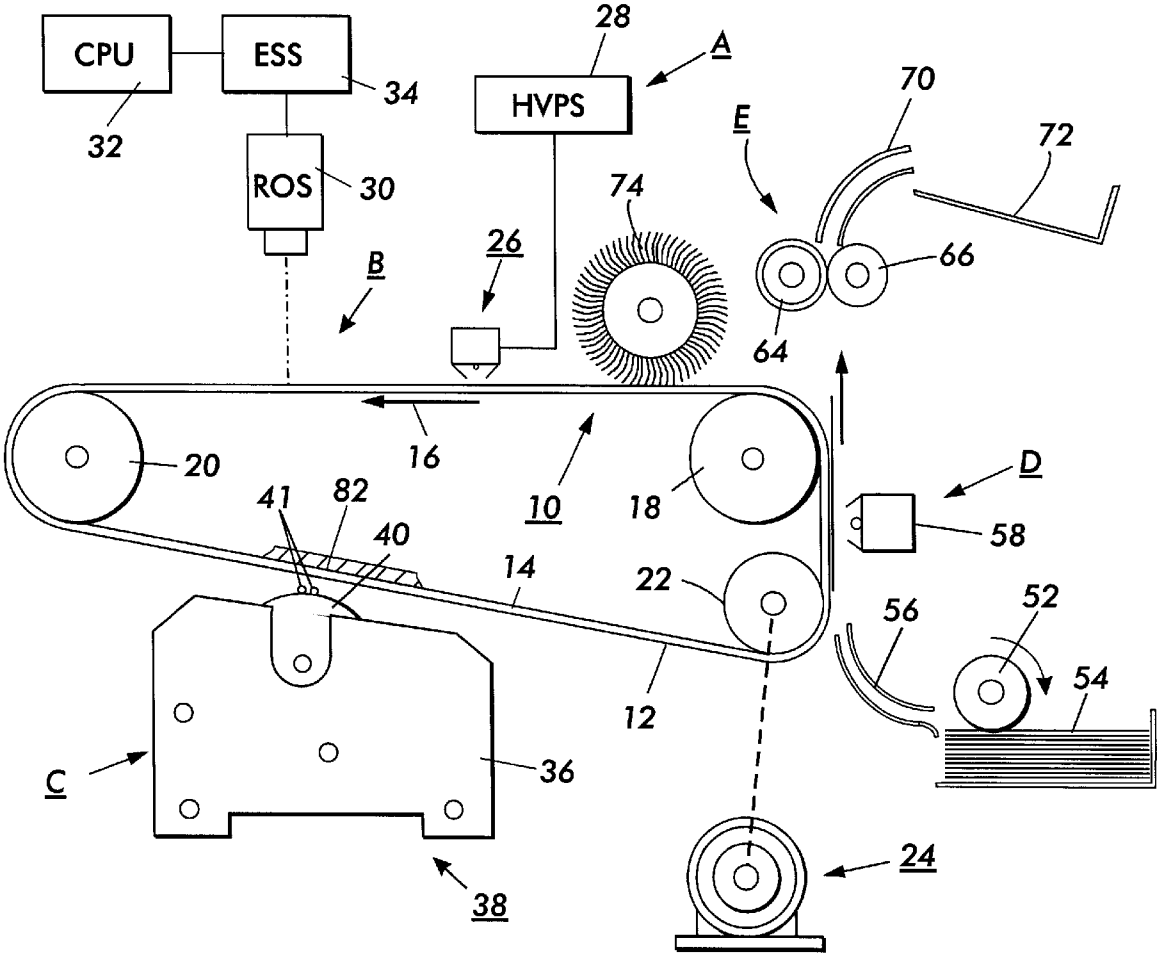
FIG. 3 a schematic, elevational view of an illustrative electrophotographic printing machine incorporating the FIG. 1 development apparatus therein.

As shown in FIG. 3, the illustrative electrophotographic printing machine incorporates the development apparatus (FIG. 1) of the present invention therein. The printing machine includes a photoreceptor 10 in the form of a belt having a photoconductive surface 12 on a conductive substrate 14. Substrate 14 is preferably made from an aluminum alloy which is electrically grounded. The belt is driven by means of a motor 24 along a path defined by rollers 18, 20, and 22 in the direction of arrow 16.

Initially, a portion of belt 10 passes through charging station A. At charging station A, a corona generator 26 charges photoconductive surface 12 to a relative high, substantially uniform potential. A high voltage power supply 28 is electrically connected to corona generator 26. After charging, the charged area of photoconductive surface 12 advances to exposure station B.

At exposure station B, a raster output scanner (ROS) generates a modulated laser light beam. The modulated light beam is directed onto the charged region of photoconductive surface 12 to selectively dissipate the charge thereon. This records an electrostatic latent image corresponding to the document desired to be printed. A centralized processing unit (CPU) 32 and electronic subsystem (ESS) 34 are associated with ROS 30 to process the image data being transmitted thereto. The centralized processing unit counts the number of dark pixels and light pixels in the image being printed by the printing machine. Inasmuch the number of dark pixels and light pixels in the document being printed is a measurement of the amount of toner particles required to develop the latent image, this provides a measurement of the average amount of toner particles required to develop the latent image.

After the electrostatic latent image has been recorded on photoconductive surface 12, belt 10 advances the latent image to development station C. At development station C, a development system develops the latent image recorded on the photoconductive surface. Preferably, the development system includes a donor roller 40 and electrode wires 41 positioned in the gap between donor roll 40 and photoconductive belt 10. Electrode wires 41 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in the chamber of developer housing 38. The chamber in developer housing 36 stores a supply of developer material. The developer materials is a two component developer material of at least magnetic carrier granules having toner particles adhering triboelectrically thereto. One skilled in the art will appreciate that a single component developer material of magnetic toner particles may also be used. A magnetic roller disposed interiorly of the chamber of housing 38 conveys the developer material to the donor roller. The magnetic roller is electrically biased relative to the donor roller so that the toner particles are attracted from the magnetic roller to the donor roller. The development apparatus will be discussed hereinafter, in greater detail, with reference to FIG. 2.

Figure 1:
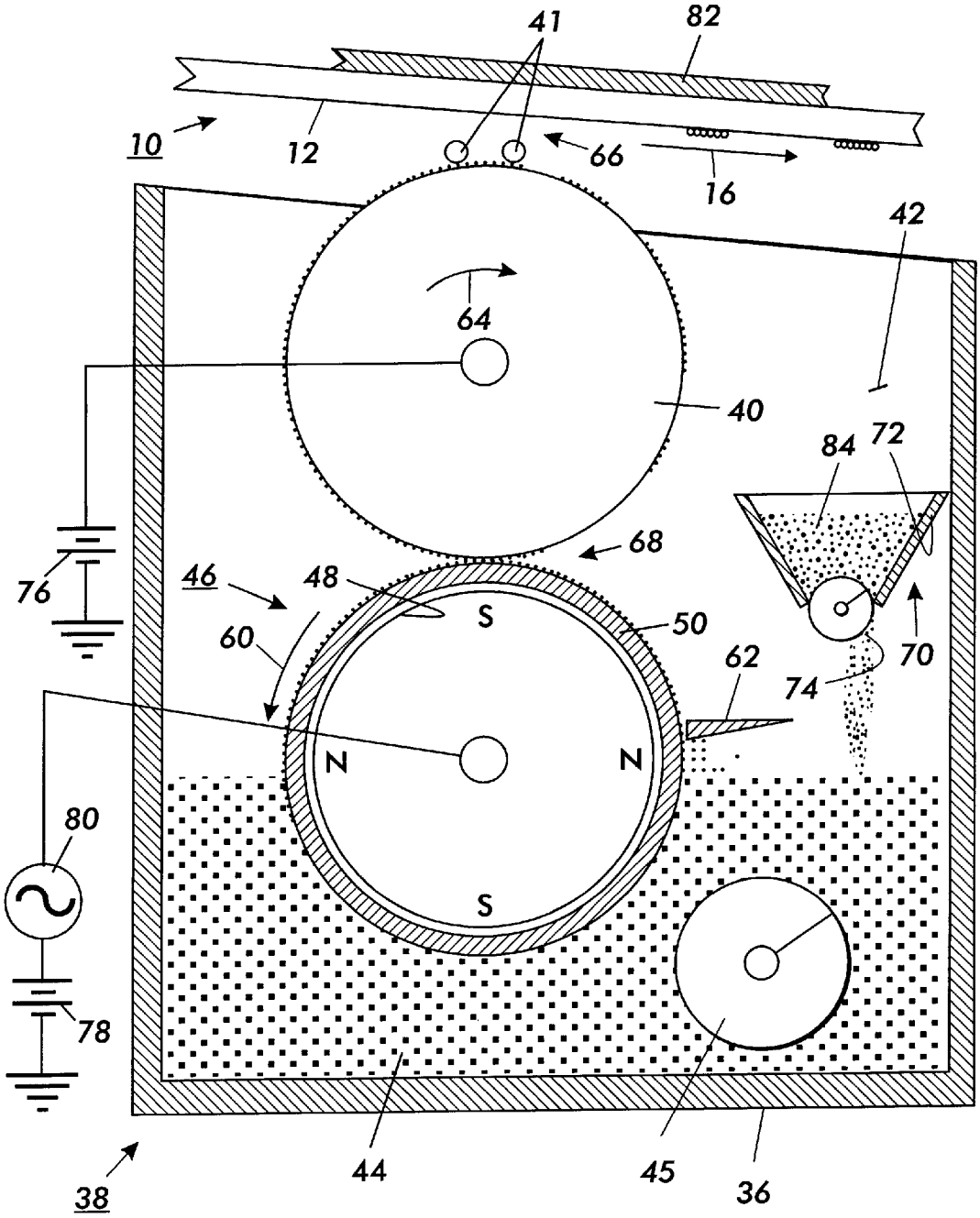
FIG. 1 is a schematic, elevational view showing the development apparatus used in the FIG. 3 printing machine.

With continued reference to FIG. 1, after the electrostatic latent image has been developed, belt 10 advances the developed image to transfer station D. At transfer station D, a copy sheet 54 is advanced by roll 52 and guides 56 into contact with the developed image on belt 10. A corona generator 58 is used to spray ions on to the backside of the sheet so as to attract the toner image from belt 10 to the sheet. As the belt turns a round roller 18, the sheet is stripped therefrom with the toner image thereon.

After transfer, the sheet is advanced by a conveyor (not shown) to fusing station E. Fusing station E includes a heater fuser roller 64 and a back up roller 66. The sheet passes between fuser roller 64 and back up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 2:
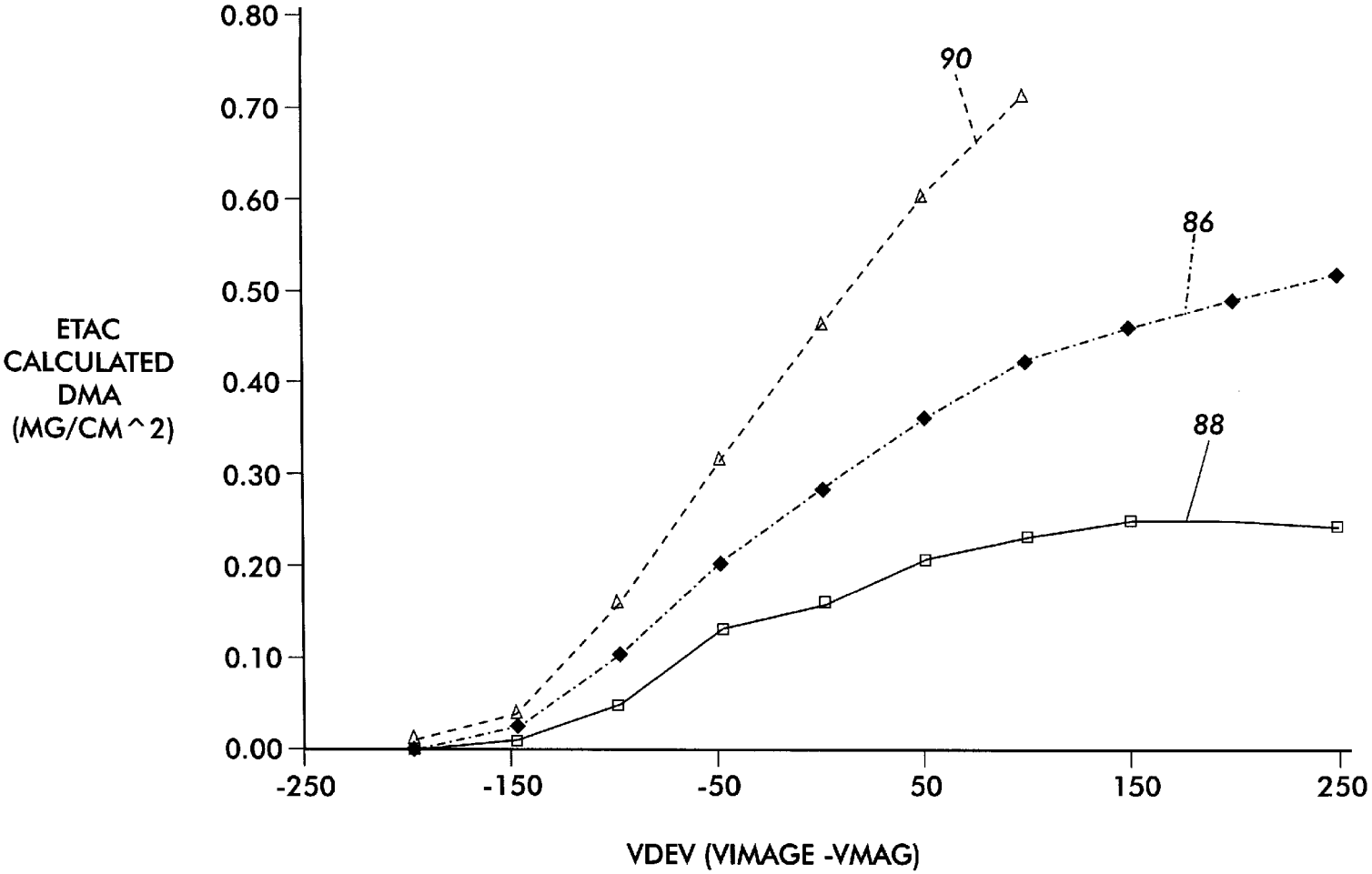
FIG. 2 is a graph showing three development curves measuring the performance of the development system.

Referring now to FIG. 2, there is shown development apparatus 38 in greater detail Housing 36 defines a chamber 42 for storing a supply of developer material 44 therein. Positioned at the bottom of housing 36 in chamber 42 is a horizontal auger 45 which distributes developer material substantially uniformly along the length of transport roller 46. In this way, the lowermost portion of transport roller 46 is immersed in developer material 44.

Transport roller 46 includes a stationary, multi-polar magnet 48 having a closely spaced sleeve 50 of non-magnetic material, preferably aluminum or stainless steel sleeve, mounted rotatably thereabout. Thus, sleeve 50 rotates about magnetic core 48 in the direction of arrow 60. The developer material is attracted to the exterior circumferential surface of sleeve 50. A metering blade 62, is used to adjust the thickness of the developer material adhering to sleeve 50 as it rotates into the nip 68 between transport roller 46 and donor roll 40. A DC power supply 76 electrically biases donor roll 40 to a selected voltage potential. Transport roll 46 is electrically biased by both a DC voltage source 78 and an AC voltage source 80. The effect of the DC electrical field is to enhance the attraction of developer material to sleeve 50. It is believed that the effect of the AC electrical field applied along the transport roll in nip 68 is to loosen the toner particles from the carrier granules. In this way, the differential potential between the electrical biases on donor roll 40 and transport roll 46 causes the toner particles to be transferred from the carrier granules on transport roll 46 to donor roll 40 in nip 68. Preferably, donor roll is made from a material sufficiently conductive to prevent the build-up of electrical charge with respect to time and yet is adequately conductive to form a blocking layer so as to prevent shorting or arching of the magnetic brush when in contact with the donor roll. By way of example, donor roller 40 may be made from aluminum having an anodized or sprayed ceramic coating thereon. Donor roller 40 rotates in the direction of arrow 64. As donor roller 40 rotates in the direction of arrow 64, it advances the toner particles adhering to the exterior circumferential surface thereof into development zone 66. Electrodes 41 are located in development zone 66. Development zone 66 is defined as the gap or space between belt 10 and donor roller 40. A pair of electrode wires 41 are shown extending in a direction substantially parallel to the longitudinal axis of the donor roller. Electrode wires 41 are made from thin tungsten wires or stainless steel wires coated with polytetrafluorethylene which are closely spaced from donor roller 40. An alternating electrical bias is applied to electrode wires by an AC voltage source. The applied AC voltage establishes an alternating electrostatic field between electrode wires 41 and donor roll 40 which is effective in detaching toner particles from the surface of donor roller 40 and forming a toner powder cloud about wires 41.

A stationary shoe, 82, contacts the inner surface of belt 10. The position of shoe 82 relative to donor roll 40 establishes the spacing between donor roll 40 and belt 10. The position of shoe 82 is adjustable and positioned so that the spacing between donor roll 40 and photoconductive surface 12 is preferably about 0.25 mm. The electrostatic latent image recorded on photoconductive surface 12 attracts toner particles from the toner powder cloud in development zone 66 to develop the latent image, forming a visible toner powder image on photoconductive surface 12.

With continued reference to FIG. 1, a discharging unit 70 periodically dispenses a flow additive material into developer material 44 in chamber 42 of housing 36. Discharging unit 70 includes an open ended hopper 72, having a foam roller 74 positioned in the open end thereof. A flow additive material 84 is stored in hopper 72. Examples of flow additives include colloidal silicas such as aerosol, a registered trademark, metal salts, and metal salts of fatty acids inclusive of zinc stearate, aluminum oxides, cerium oxides and mixtures thereof. Several of these additives are described in U.S. Pat. Nos. 3,590,000 and 3,800,588, the disclosures of which are hereby incorporated into the present application by reference thereto. CPU 32 controls a motor coupled to foam roller 74. Energization of the motor causes foam roller 74 to rotate so as to discharge flow additive material 84 from hopper 72. In this way, discharging unit 70 periodically discharges flow additive material into developer material 44 in chamber 42 of housing 36.

The time of residence of the toner particles in chamber 42 of housing 36 varies as a function of the amount of toner particles being developed on the electrostatic latent image. The required amount of toner particles being developed on the electrostatic latent image is a function of the number of black pixels and white pixels in the image being printed. Thus, the average number of toner particles for any given document being printed is a function of the number of black pixels and white pixels detected in the image being printed. If the document being printed requires a greater amount of toner particles, the document being printed requires a greater amount of toner particles, and the toner particle residence time in chamber 42 of housing 36 is reduced. Contrawise, if the document being printed has a lesser number of indicia thereon and requires a lesser number of toner particles, the residence time of the toner particles in chamber 42 of housing 36 increases. Hence, the residence or elapsed time of toner particles in chamber 42 of housing 36 varies inversely as a function of the average number of toner particles required on the document being printed. Clearly, this is a function of the black and white pixels contained in the original document being printed and being detected by CPU 32. Thus, CPU 32 counts the number of dark pixels an light pixels in each document being printed and, as a function thereof, measures the average amount of toner particles required on each of these documents. After the measured average amount of toner particles has reaches a preselected count as measured by the pixel count, CPU 32 activates the motor coupled to foam roller 74 so as to discharge flow additive material 84 from hopper 72 into developer material 44 in chamber 42 of developer housing 36.

It has been found that as the toner particles remain in the developer housing, they become more sticky. Sticky toner particles do not flow well and do not form a toner powder cloud in the development zone satisfactorily. This leads to image degradation. By periodically adding a flow additive into the developer material, this stickiness is substantially eliminated and the toner particles remain substantially free-flowing. This optimizes the formation of the toner powder cloud in development zone 66 so that the toner particles are readily attracted and moved to the electrostatic latent image formed on photoconductive surface 12 of belt. 10. In this way, image degradation is minimized. It has been found that there is a substantially improvement in developability as a result of adding a flow additive material periodically to the developer material. This is clearly shown in FIG. 2 which depicts comparison graphs to illustrate the significant improvement resulting from the present invention.

One skilled in the art will appreciate that the flow additives may be present in the amount of from about 0.1% by weight to about 10% by weight, and preferably, in an amount of from about 0.1% by weight to about 5% by weight in the developer material.

Turning now to FIG. 2, there are shown three development curves. A development curve is a common metric for measuring the performance of the developer unit. Curve 86 was plotted when the residence time of the toner particles in the developer housing was relatively low. This curve indicates that the developability is satisfactory. Several hundreds of prints of a low average print coverage were then run. This increased the average residence time of the toner particles in the developer housing since relatively little toner was needed to develop the latent image. Curve 88 was then generated. When comparing curve 88 with curve 86, it is clear that there has been a gross drop off in developability between the curves. Thereafter, a flow additive material was added to the developer material. Curve 90 was then generated. This curve clearly illustrates a dramatic improvement in developability when compared with curve 88 and curve 86. The triboelectric characteristics for all of these curves remained substantially constant. Thus, it is clear that when the proper amount of flow additive is intermixed with the developer material in the developer housing, there is a significant improvement in developability.

One skilled in the art will appreciate that toner particles may be dispensed with the flow additive material. Thus, hopper 72 may store a flow additive material as well as toner particles. In this embodiment, both the toner particles and flow additive material are simultaneously discharged into the developer material. In this way, both the concentration of toner particles within the developer material and the amount of flow additive material are maintained at substantially optimum levels. This ensures that the toner particles are relatively free flowing, minimizing developability degradation and optimizing print quality.

In recapitulation, it is clear that the development apparatus of the present invention periodically adds a flow additive material to the development material within the chamber of the development housing so as to optimize developability. It has been found that when a flow additive material is periodically added to the developer material, there is a significant improvement in developability. Flow additive material is added to the developer material in direct proportion to the elapsed time of the developer material within the developer housing, or in an inverse proportion to the throughput of the printing machine. Thus, high throughput printing machines have less flow additive material added thereto than low throughput printing machines. Of course, the density or average toner particle usage on each document is also determinative of the time of residence of the toner particles within the developer material. In this way, by counting the number of pixels within each document being printed and determining the average toner particle requirement for that document, the selected actuation time for dispensing flow additive material into the developer material may be readily determined.

It is, therefore, evident that there has been provided in accordance with the present invention, an apparatus for developing an electrostatic latent image that adds a flow additive material to the developer material to significantly improve developability. This apparatus fully satisfied the aims and advantages hereinbefore set forth. While this invention has been described in conjunction with various embodiments and methods of use, it is evident that many alternatives, modifications and variations will be apparent to those skilled in the art. Accordingly, it is intended to embrace all such alternatives, modifications, and variations that fall within the spirit and broad scope of the appended claims.

What is claimed is:

1. An apparatus for developing a latent image, including:

a housing defining a chamber for storing a supply of developer material comprising at least toner particles;

a developer member, mounted at least partially in said housing, to transport developer material to the latent image to develop the latent image with toner particles;

a discharging device, operatively associated with said housing, for dispensing a flow additive into the developer material in said housing to minimize developability degradation as a function of elapsed time; and a device for measuring the duration of time of toner particle residence in the chamber of said housing, said measuring device being in communication with said discharging device to activate said discharging device in response to a selected duration of time having elapsed.

2. An apparatus according to claim 1, wherein said measuring device detects the average amount of toner particles required to develop the latent image and varies the selected duration of time in response thereto.

3. An apparatus according to claim 2, wherein said measuring device varies the selected duration of time inversely in response to the amount toner particles required to develop the latent image.

4. An apparatus according to claim 1, wherein said discharging device dispenses toner particles and the flow additive.

5. An apparatus according to claim 1, wherein the flow additive includes an additive selected from a group consisting of colloidal silicas, zinc stearate, aluminum oxides and cerium oxides.

6. An apparatus according to claim 1, wherein said dispensing device includes a container defining a chamber storing a supply of flow additives therein.

7. An apparatus according to claim 6, wherein said developer member includes:

a donor roll, mounted at least partially in the chamber of said housing, said donor roll being adapted to advance developer material to the latent image; and a magnetic transport roll, mounted in the chamber of said housing and being positioned adjacent said donor roll, said transport roll being adapted to advance developer material to said donor roll.

8. An apparatus according to claim 6, wherein the developer material includes carrier granules.

9. A cartridge, including:

a housing defining a chamber storing a supply of a flow additive material therein;

a dispensing mechanism, operatively associate with said housing, for discharging the flow additive material from the chamber of said housing; and a device for measuring the duration of time of toner particle residence in the chamber of said housing, said measuring device being in communication with said dispensing mechanism to activate said dispensing mechanism in response to a select duration of time having elapsed.

10. A cartridge according to claim 9, adapted to be operatively associated with a developer unit defining a chamber storing a supply of developer material comprising at least toner particles, wherein said dispensing mechanism discharges the flow additive material from the chamber of said housing into the chamber of the developer unit.

11. A cartridge according to claim 10, wherein said housing further includes a supply of toner particles in the chamber thereof and said dispensing mechanism discharges toner particles and the flow additive material.

12. A cartridge according to claim 11, wherein the flow additive material includes an additive selected from a group consisting of colloidal silicas, zinc stearate, aluminum oxides and cerium oxides.

13. A cartridge according to claim 12, wherein said developer unit includes a supply of developer material in the chamber thereof.

14. A printing machine of the type having a latent image recorded on an image bearing member, wherein the improvement includes:

a housing defining a chamber for storing a supply of developer material comprising at least toner particles;

a developer member, mounted at least partially in said housing, to transport developer material to the latent image to develop the latent image with toner particles;

a discharging device, operatively associated with said housing, for dispensing a flow additive into the developer material in the chamber of said housing to minimize developability degradation as a function of elapsed time; and a device for measuring the duration of time of toner particle residence in the chamber of said housing, said measuring device being in communication with said discharging device to activate said discharging device in response to a selected duration of time having elapsed.

15. A printing machine according to claim 14, wherein said measuring device detects the average amount of toner required to develop the latent image and varies the selected duration of time in response thereto.

16. A printing machine according to claim 15, wherein said measuring device varies the selected duration of time inversely in response to the amount toner required to develop the latent image.

17. A printing machine according to claim 14, wherein said discharging device dispenses toner particles and the flow additive.

18. A printing machine according to claim 14, wherein the flow additive includes an additive selected from a group consisting of colloidal silicas, zinc stearate, aluminum oxides and cerium oxides.

19. A printing machine according to claim 14, wherein said dispensing device includes a container defining a chamber storing a supply of flow additives therein.

20. A printing machine according to claim 19, wherein said developer member includes:

a donor roll, mounted at least partially in the chamber of said housing, said donor roll being adapted to advance developer material to the latent image; and a magnetic transport roll, mounted in the chamber of said housing and being positioned adjacent said donor roll, said transport roll being adapted to advance developer material to said donor roll.

21. A printing machine according to claim 19, wherein the developer material includes carrier granules.

22. A method of developing an electrostatic latent image recorded on a photoconductive member used in an electrophotographic printing machine, including:

transporting a developer material comprising at least toner particles from a housing storing a supply thereof in a chamber to the photoconductive member having the electrostatic latent image recorded thereon;

discharging a flow additive into the developer material in chamber of the housing to minimize developability degradation as a function of time; and measuring the duration of time of toner particle residence in the chamber of the housing; and activating said step of discharging in response to measuring an elapse of a selected duration of time.

23. A method according to claim 22, wherein said step of measuring, includes detecting the average amount of toner particles required to develop the latent image; and varying the selected duration of time in response to the average amount of toner particles detected in said detecting step.

24. A method according to claim 23, wherein said varying step varies the selected duration of time inversely in response to the amount of toner particles required to develop the latent image.

25. A method according to claim 22, wherein said discharging step discharges toner particles and the flow additive.

* * * * *